United States Patent [19]

Takagi et al.

[11] Patent Number: 4,747,775

[45] Date of Patent: May 31, 1988

[54] SKID BEAM FOR HEATING FURNACES OF WALKING BEAM TYPE

[75] Inventors: Kiyoshi Takagi, Okayama; Tadashi Naito, Kurashiki; Osamu Nakatani, Kurashiki; Toshio Inoue, Kurashiki; Masamitsu Obashi, Kurashiki; Hisashi Hiraishi, Kyoto; Akira Shinosaki, Hirakata; Tohru Kawai, Toyonaka, all of Japan

[73] Assignees: Kawasaki Steel Corporation, Hyogo; Kubota Ltd., Osaka, both of Japan

[21] Appl. No.: 59,971

[22] Filed: Jun. 9, 1987

[30] Foreign Application Priority Data

| | | | |
|---|---|---|---|
| Jun. 10, 1986 | [JP] | Japan | 61-134660 |
| Aug. 18, 1986 | [JP] | Japan | 61-193194 |
| Aug. 18, 1986 | [JP] | Japan | 61-193195 |

[51] Int. Cl.[4] ..... F27D 3/02

[52] U.S. Cl. ..... 432/234; 432/235

[58] Field of Search ..... 432/233, 234, 235, 122–124

[56] References Cited

U.S. PATENT DOCUMENTS

| | | | |
|---|---|---|---|
| 3,637,198 | 1/1972 | Knaak | 432/234 |
| 3,647,194 | 3/1972 | Brungraber et al. | 432/234 |
| 4,056,351 | 11/1977 | Knaak | 432/235 |
| 4,391,587 | 7/1983 | Murakami et al. | 432/235 |
| 4,601,659 | 7/1986 | Webster et al. | 432/234 |
| 4,609,347 | 9/1986 | Yamashita et al. | 432/234 |
| 4,689,009 | 8/1987 | Heuss | 432/235 |

FOREIGN PATENT DOCUMENTS

| | | |
|---|---|---|
| 2180718 | 11/1973 | France . |
| 2585119 | 1/1987 | France . |
| 58-81922 | 5/1983 | Japan . |
| 60-26615 | 2/1985 | Japan . |
| 60-89516 | 5/1985 | Japan . |
| 60-100616 | 6/1985 | Japan . |

*Primary Examiner*—Henry C. Yuen

*Attorney, Agent, or Firm*—Armstrong, Nikaido, Marmelstein & Kubovcik

[57] ABSTRACT

A skid beam for use in a walking beam type heating furnace which has operating temperature exceeding 1000° C. comprises a hollow skid pipe of heat resistant alloy, skid buttons provided upright on the skid pipe and arranged axially thereof at a predetermined spacing, and a refractory lining covering the outer peripheral surface of the skid pipe and each of the skid buttons over the base portion thereof toward its upper portion. Each of the skid buttons comprises a first member attached to the skid pipe and made of a heat-resistant alloy, and a second member to be brought into contact with the material to be heated. The second member is made of a composite material composed of a heat-resistant alloy and ceramic particles dispersed therein in an amount of 30 to 70% by weight based on the composite material. The skid button has a height exceeding 120 mm. The lining portion covering the skid button over the base portion thereof toward its upper portion has a thickness so as not to give a temperature difference of 40° C. between the top of the skid button and the interior of the furnace.

8 Claims, 5 Drawing Sheets

SKID BEAM FOR HEATING FURNACES OF WALKING BEAM TYPE

FIELD OF THE INVENTION

The present invention relates to skid beams for heating furnaces of the walking beam type.

BACKGROUND OF THE INVENTION

Walking beam type heating furnaces are used in the hot rolling process for heating steel materials such as steel billets, slabs or the like. For supporting and transporting the steel billet, slab or like material to be heated, the furnace has a plurality of rows of skid beams including movable beams and fixed beams. The movable beams periodically repeat vertical and horizontal reciprocating movements to transport the material while alternately transferring the material between the movable beam and the fixed beam.

FIG. 1 shows a skid beam 1 for the walking beam type heating furnace. The beam 1 comprises a hollow skid pipe 10 of heat-resistant alloy and a plurality of skid buttons 12 provided on the pipe 10 as arranged axially thereof at a given spacing. The skid beam 1, which is disposed inside the furnace, has a refractory lining 14 covering the outer periphery of the skid pipe 10 and also covering the skid buttons 12 over the base portion thereof to its upper portion.

With reference to FIG. 6, the skid button 12 of the conventional skid beam is in the form of a block of heat-resistant alloy (such as heat-resistant cobalt cast steel or heat-resistant nickel-chromium cast steel) which is fixedly joined to the skid pipe 10 by welding. Since the interior of the furnace is maintained at a high temperature usually of at least about 1000° C., cooling water is passed through the hollow channel of the skid pipe, thereby preventing the skid pipe from bending, buckling or like formation accompanied by elevated temperature and permitting the pipe to retain flexural strength against the load of the material placed thereon. Further the refractory lining 14, for example, of a castable material covering the surface of the skip pipe suppresses a rise in the temperature of the cooling water and protects the skid pipe from the high-temperature oxidizing atmosphere.

The skid button is influenced by the colling water flowing through the skid pipe and therefore has a lower temperature than the interior of the furnace, with the result that the steel material placed on the top of the skid button is deprived of heat at the portion thereof in contact with the skid button. Thus, the contact of the skid button locally creates a low-temperature portion (a so-called skid mark) in the material, hence the problem of uneven heating. If the uneven heating becomes pronounced, the subsequent rolling step will be seriously affected.

It appears that the skid mark can be eliminated by increasing the height of the skid button and thereby reducing the influence of the cooling water on the top portion of the button. However, an increase in the height of the skid button permits the skid button to have a higher temperature close to the internal temperature of the furnace, consequently reducing the compressive strength of the skid button and allowing the button to undergo compressive deformation because the skid button is usually made of heat-resistant cobalt or nickel-chromium cast steel. The skid button must then be replaced in a short period of time.

It also appears possible to preclude the compressive deformation by giving an increased cross sectional area to the skid button to thereby increase the area of contact between the button and the material to be heated and diminish the compressive load on the button per unit area. Nevertheless, an increase in the contact area correspondingly decreases the surface area of the material to be exposed to the atmosphere of the furnace inside to result in a lower heating efficiency, is liable to entail insufficient heating and an uneven temperature distribution and fails to effectively obviate the drawback.

It further appears possible to use a skid button of sintered ceramic material which has high heat resistivity and high compressive strength at high temperatures. However, while transporting the material to be heated, the skid button is repeatedly subjected not only to a static load but also to a great dynamic load, so that the ceramic skid button, which is low in toughness, is prone to cracking or spalling. Moreover, the ceramic skid button can not be welded directly to the skid pipe and is therefore difficult to attach to the skid pipe. For example, a box-shaped skid button may be fittable in a mount member of heat-resistant alloy, but the button, if having an increased height, is very unstable and is liable to slip off the place, failing to assure the furnace of a stable operation.

SUMMARY OF THE INVENTION

The main object of the present invention which has been accomplished in view of the foregoing problems is to provide a skid beam for use in the walking beam type heating furnaces which has high resistance to compressive deformation at high temperatures and high impact resistance and which permits uniform heating of materials.

More specifically, it is an object of the invention to provide a skid beam which comprises a hollow skid pipe of heat-resistant alloy and skid buttons provided upright on the skid pipe and arranged axially thereof at a predetermined spacing, each of the skid buttons comprising a first member attached to the skid pipe and a second member to be brought into contact with the material to be heated, a lining covering the outer peripheral surface of the skid pipe and each skid button over the base portion thereof toward its upper portion, the first member being made of a heat-resistant alloy, the second member being made of a composite material comprising a heat-resistant alloy matrix and ceramic particles dispersed therein in an amount of 30 to 70% by weight based on the composite material, the skid button having a height exceeding 120 mm.

DESCRIPTION OF THE PREFERRED EMBODIMENTS

Figure 1:
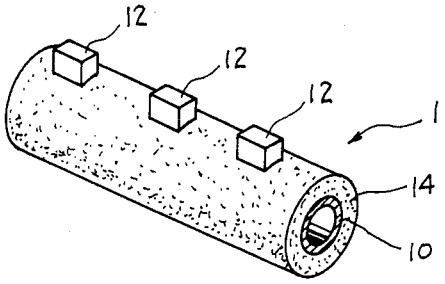
FIG. 1 is a perspective view showing a skid beam for heating furnaces of the walking beam type.

Skid beams embodying the invention will be described below in detail with reference to the accompanying drawings. However, it should be understood that the following embodiments are given for illustrative purposes only and the invention is not limited thereto.

FIGS. 2 to 5 show skid beams 1 embodying the invention. Each of these beams 1 comprises a skid pipe 10, and skid buttons 12 each of which comprises a first member 12*a* attached to the skid pipe 10 and serving as a base and a second member 12*b* joined to the upper portion of the first member 12*a* and adapted to be brought into contact with the material to be heated. A refractory lining 14 is provided over the outer peripheral surface of the skid pipe 10 and over the base portion of the skid button 12 toward its upper portion. The first member 12*a* is made of a heat-reisistant alloy and the second member 12*b* is made of a composite material of heat-resistant alloy and a ceramic material. More specifically, the composite material comprises a heat-resistant alloy as a matrix and ceramic particles admixed therewith in an amount of 30 to 70% by weight based on the composite material. Examples of useful heat-resistant alloys include heat-resistant cobalt cast steel and heat-resistant nickelchromium cast steel. A castable material, for example, is useful for the lining 14.

To prepare the composite material for the second member, the heat resistant alloy and a ceramic material are mixed together in a molten state and then cooled fast, whereby fine ceramic particles, 0.01 to 0.1 μm in size, are uniformly dispersed in a matrix of the alloy. The dispersed particles and the matrix of heat-resistant alloy produce a combined effect to give the resulting material high compressive strength and toughness at high temperatures. The composite material can be said to be a material intermediate between the brittle fine ceramic material and the ductile alloy material. The characteristics of the composite material can be altered by varying the ceramic content.

The skid button of the predetermined shape can be prepared by melting the composite material, for example, with a tungsten inert gas arc source and joining the material with the first member of heat-resistant alloy.

Figure 7A:
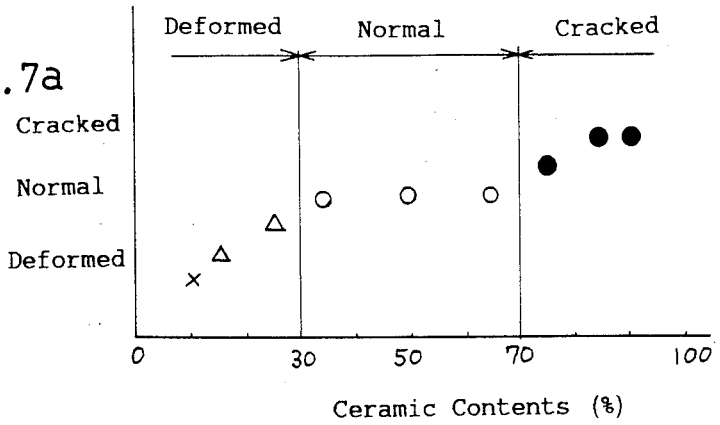
FIG. 7*a* is a diagram showing experimental results obtained using skid buttons of different ceramic contents.

We have tested the composite material for performance in an actual heating furnace at varying cermatic contents (% by weight) and found that the material is usable for a prolonged period of time free of cracking or compressive deformation when containing 30 to 70% by weight of ceramic particles. The test was conducted under the following conditions. FIG. 7*a* shows the results.

Temperature of furnace inside: 1280° C.

Skid buttons: 500 mm in width, 130 mm in length and 200 mm in height

Material heated (slab): 220–260 mm in thickness

Walking beam motion: About 100,000 times

Skid buttons were prepared with a ceramic content of 10, 15, 25, 35, 50, 65, 75, 85 or 90% by weight, and two buttons of each content were attached to skid pipes. Slabs were randomly placed into the furnace. The symbols shown in FIG. 7*a* represent the following results.

X: Marked compressive deformation (3–10 mm)

Δ: Small compressive deformation (0.5–3 mm)

○: Normal (inclusive of slight deformation that is not objectionable to use)

●: Spalling or cracking in the upper edge portion of the button

Figure 7B:
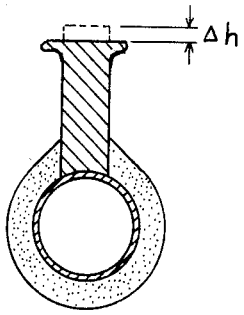
FIG. 7*b* is a cross sectional view for explaining the compressive deformation of skid buttons.

In the above deformation, the numeral value indicates decreased height Δh (See FIG. 7*b*) of the skid button from the original height, which is generated by the compressive deformation.

The results shown in FIG. 7*a* indicate that the skid button exhibits excellent performance when containing 30 to 70% by weight of ceramic particles.

The analysis of the test results revealed the following.

Figure 8:
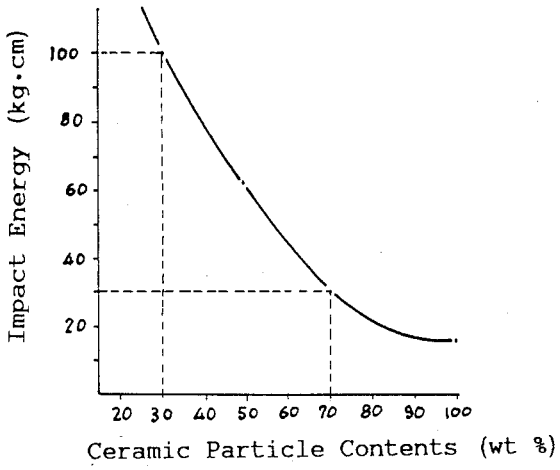
FIG. 8 is a graph showing the relationship between the ceramic content and the impact energy.
Figure 9:
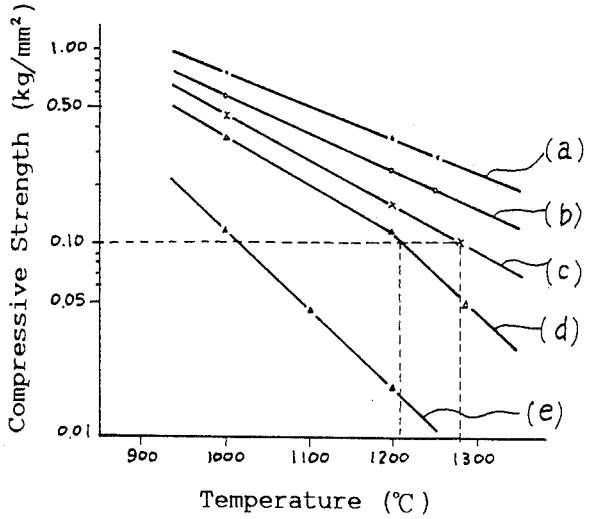
FIG. 9 is a graph showing the relationship between the temperature and the compressive strength of different materials.

FIG. 8 shows the relationship between the high-temperature toughness value of the composite material and the ceramic content, and FIG. 9 shows the high-temperature compressive strength of composite materials in comparison with that of heat-resistant alloys. With reference to FIG. 9, composite materials containing 70, 50 and 30% by weight of ceramic particles are represented by lines (a), (b) and (c), respectively, a cobalt alloy by line (d) and a nickel-chromium alloy by line (e). FIG. 8 reveals that the impact energy is 100 kg. cm at a ceramic amount of 30% by weight and that the toughness decreases with increasing ceramic content. However, it is seen that the impact energy is still 30 kg. cm at a content of 70% by weight. Accordingly, the problem of cracking can be overcome when the impact energy value is at least 30 kg. cm. With reference to FIG. 9, the cobalt alloy (d), for example, becomes lower than 0.10 kg/mm$^2$ in compressive strength at temperatures exceeding 1210° C., whereas the composite materials (a), (b) and (c) containing at least 30% by weight of ceramic particles retain a high compressive strength of at least 0.10 kg/mm$^2$ at a high temperature of 1280° C.

In order to effectively prevent occurrence of skid marks in the material transported as placed on the top portions of skid buttons, we found it necessary that the temperature difference between the top of the skid button and the interior of the furnace be not larger than 40° C . The temperature difference between the internal temperature of the furnace and the skid button which is within the temperature zone of the internal atmosphere of the furnace is attributable to the influence on the skid button of the cooling water flowing through the skid pipe. Accordingly, the higher the skid button, the less is the influence of the cooling water through the skid pipe and therefore the smaller is the temperature difference. Further as the thickness of the lining increases, a correspondingly increased heat insulating effect is available to suppress the rise in the temperature of the cooling water, with the result that the temperature difference becomes greater since the skid button is influenced by the cooling water of lower temperature.

Figure 2:
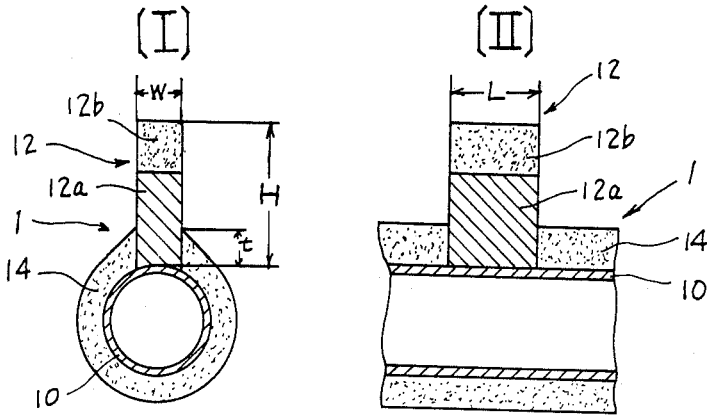
FIGS. 2 to 5 show different skid buttons embodying the invention, the section (I) of each of these drawings being a cross sectional view, the section (II) thereof being a longitudinal view in section along the axis of the beam.
Figure 10:
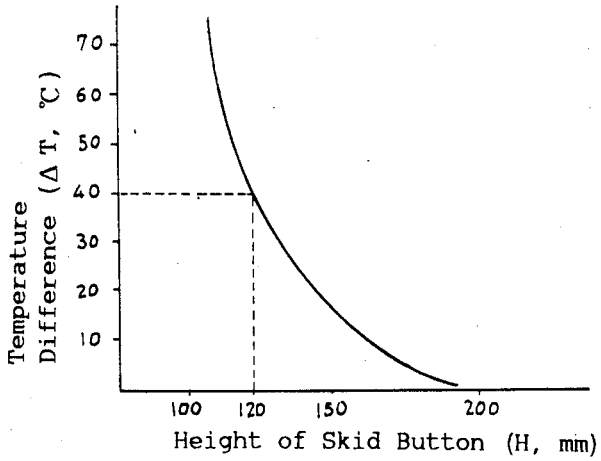
FIG. 10 is a graph showing the relationship between the height of skid buttons and the temperature difference between the skid button top portion and the interior of a furnace.

Accordingly, measurements were made of the temperature difference ΔT between the temperature of skid buttons and the internal temperature of the furnace at varying heights of skid buttons with the thickness of the lining maintained at a constant value. FIG. 10 shows the results. With reference to FIG. 2 (I), the term "height of skid button" refers to the distance H from the top surface of the skid pipe to the top of the skid button, and the term "thickness of the lining" to the dimension t over which the skid button is covered with the lining from the button portion toward its upper portion. This dimension is taken as the thickness of the lining since the substantial influence of the cooling water on the skid button is dependent on the dimension of such covered portion. The test results of FIG. 10 were obtained with a thickness t of 110 mm. The results indicate that when the skid button is higher than 120 mm, the temperature difference ΔT between the skid button and the internal temperature of the furnace is not greater than 40° C. If the thickness t of the lining is smaller than 110 mm, the cooling water produces a less influence, permitting the skid button to have a temperature closer to the internal furnace temperature.

Figure 11:
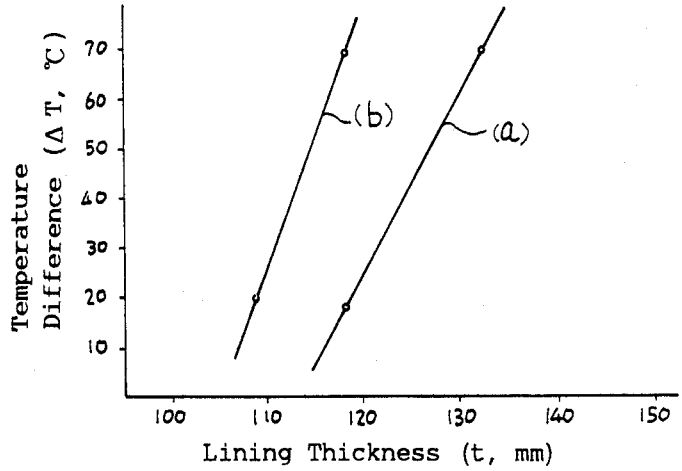
FIG. 11 is a graph showing the relationship between the lining thickness and the temperature difference between the skid button top portion and the interior of the furnace.

FIG. 11 further shows the relation between the lining thickness t and the temperature difference ΔT as determined at skid button heights of 200 mm and 150 mm. With reference to FIG. 11, line (a) represents the result achieved at a height of 200 mm, and line (b) that achieved at 150 mm. FIG. 11 reveals that there is a definite correlation between the lining thickness t and the temperature difference ΔT. It is therefore possible to determine the height of skid button first and then to determine the lining thickness t in accordance with the desired height in order that the temperature difference ΔT will not exceed 40° C.

In case the skid button is exposed to the temperature higher than 1000° C. and has a height exceeding 120 mm, we found that the skid button should be at least 30 mm at the portion extending from the liner (the dimension "H−t" in FIG. 2(I)), in view of control of the temperature difference ΔT so as not to exceed 40° C.

FIGS. 2 to 5 show various skid buttons embodying the present invention and each comprising a first member of heat-resistant alloy and a second member made of a composite material of heat-resistant alloy and ceramic particles.

The embodiment of FIG. 2 comprises a first member 12*a* and a second member 12*b* in the form of a layer and joined to the top of the first member. To diminish the influence of the cooling water flowing through the skid pipe, the skid button has an increased overall height, permitting the top portion of the button to have a temperature closer to the internal furnace temperature, whereas the button top portion is prevented from high-temperature deformation by virtue of the excellent characteristics of the ceramic composite material against compressive deformation at high temperatures as already described.

Figure 12:
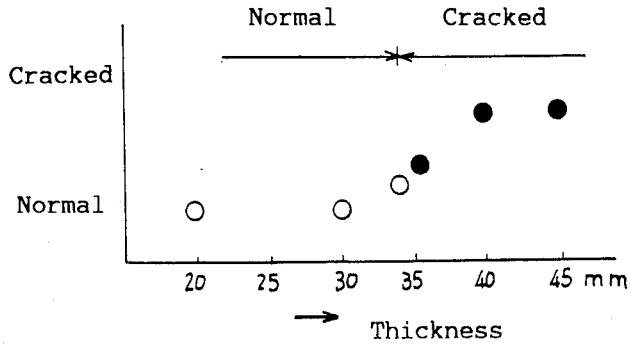
FIG. 12 is a diagram showing the relationship between the thickness of composite ceramic materials and the cracking thereof occurring during the step of joining the ceramic material with a heat-resistant alloy.

The ceramic composite material, when having a considerable thickness, is likely to crack during the melting-buildup process for joining the material with the first member of heat-resistant alloy. FIG. 12 shows the likelihood of ceramic composite material cracking when the material is bonded with the heat-resistant alloy, as determined using composite materials of varying thicknesses. In the diagram, the blank circle mark (○ mark) represents a normal (crackfree) specimen, and the solid circle mark ( ● mark) a specimen developing cracks. The degree of cracking is plotted as ordinate, such that the mark at a higher position indicates a greater degree of cracking. FIG. 12 reveals that the cracking can occur when the thickness of the composite material exceeds about 35 mm. It is therefore desirable that the ceramic composite material be smaller than about 35 mm in thickness. The present applicant accordingly proposes the embodiments of FIGS. 3 to 5.

Figure 3:
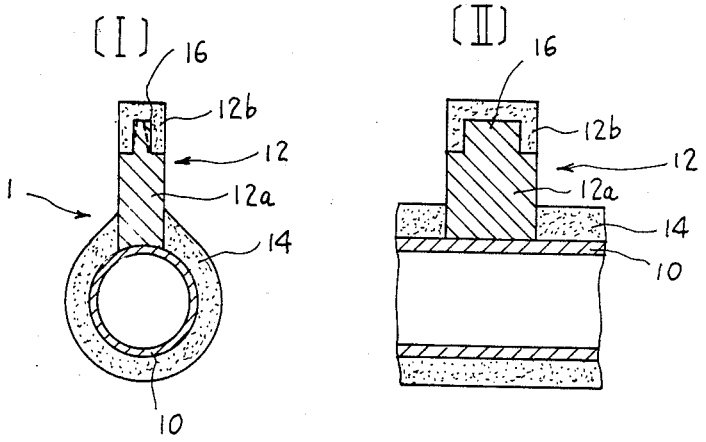

The embodiment of FIG. 3 comprises a first member 12*a* having a projection 16 approximately at its center, and a second member 12*b* in the form of a cap and covering the entire projection 16. The first member is provided with the projection to give a reduced thickness to the ceramic composite material forming the second member 12*b*. Preferably, the second member 12*b* has a thickness smaller than 35 mm between the top of the projection 16 and the top of the skid button, as well as between the outer periphery of the projection 16 and the outer periphery of the skid button. The thickness is preferably at least 8 mm, more preferably at least 12 mm since too small a thickness makes it meaningless to provide the second member of ceramic composite material. An enhanced compressive strength at high temperatures can be imparted to the top portion of the second member by forming the projection 16 of the first member with a cross sectional area decreasing from the base portion thereof toward its top and giving a reduced top area to the second member, as shown with interrupted lines in FIG. 3(I).

Figure 4:
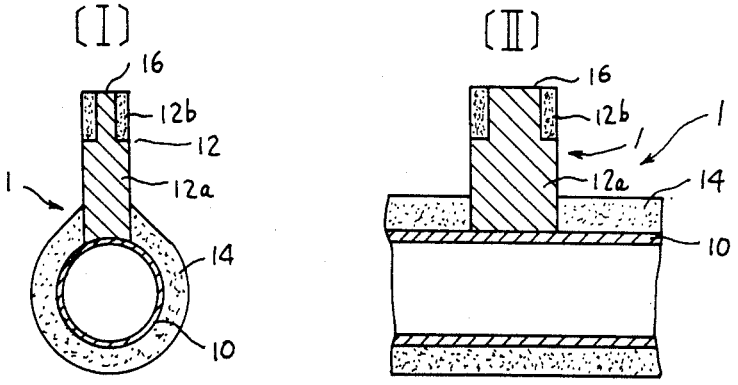

The embodiment of FIG. 4 comprises a first member 12*a* having a projection 16 approximately at its center, and a second member 12*b* in the form of a ring and covering the outer periphery of the projection 16. With this embodiment, the top portion of the skid button partly includes the first member of heat-resistant alloy and can not therefore be given greatly increased resistance to compressive deformation at high temperatures, so that this embodiment is used only in the case where the temperature of the top portion can be somewhat lower.

Figure 5:
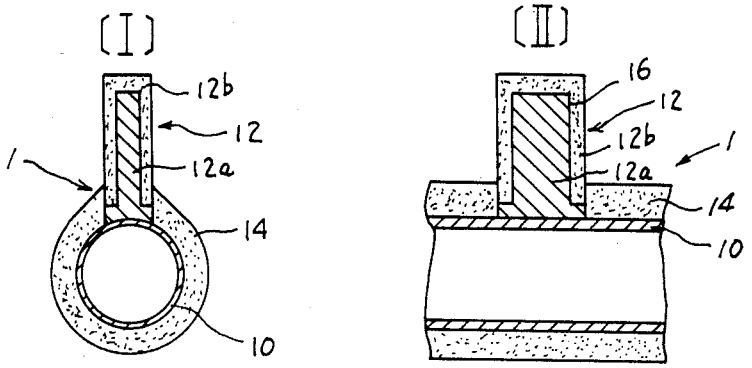
Figure 6:
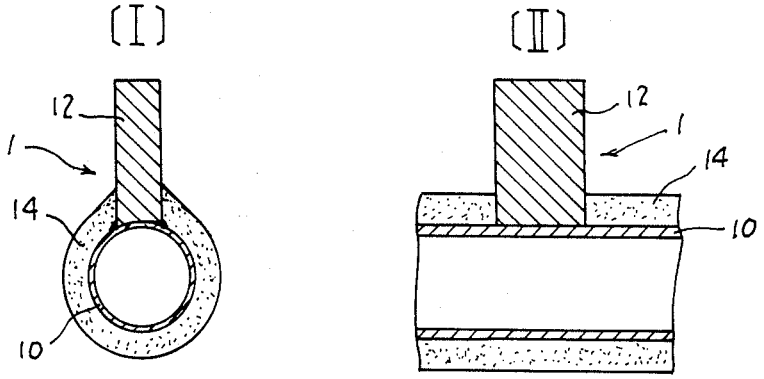
FIG. 6 shows a conventional skid button, the sections (I) and (II) thereof being a cross sectional view and a longitudinal sectional view along the beam, respectively.

The embodiment of FIG. 5 comprises a first member 12*a* in the form of a column, and a second member 12*b* covering the top and the side of the first member. This embodiment is a modification of the embodiment of FIG. 3 in that the skid button has an increased amount of ceramic composite material along its height.

With any of these embodiments, a refractory lining 14 as of castable covers the outer periphery of the skid pipe 10 and the skid button over its base portion toward the upper portion thereof.

Preferably, the embodiments of FIGS. 3 to 5 have the following feature with respect to the area ratio involved in the horizontal cross section of the button portion which comprises both the first and second members, in view of the rate of deformation of the second member at high temperatures, the coefficients of expansion of the two members, etc.

Figure 13:
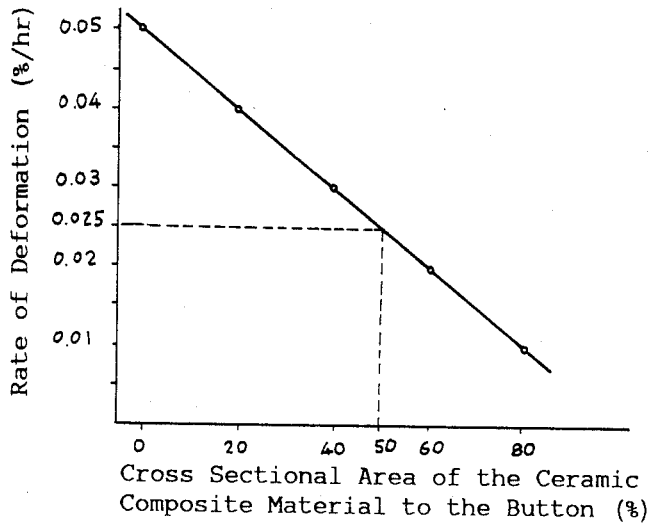
FIG. 13 is a graph showing the relationship between the rate of compressive deformation of the skid button and the cross sectional area ratio of the second member of the button.

First, the rate of deformation of the skid button under a compressive load is preferably up to 0.025%/hr when a safety factor is taken into consideration. The rate of deformation is dependent on the area ratio of the second member relative to the cross sectional area of the skid button. FIG. 13 shows the relationship between the rate of deformation (%/hr) of the skid button and the cross sectional area ratio of the second member to the button, S1/S2×100, wherein So is the entire cross sectional area of the skid button inclusive of the first and second members, and S1 is the cross sectional area of the second member, as determined at a temperature of 1250° C. under a pressure per unit area of 0.25 kg/mm$^2$. The diagram shows that the rate of deformation can be made not greater than 0.025%/hr when the cross sectional area ratio is at least 50%.

Figure 14:
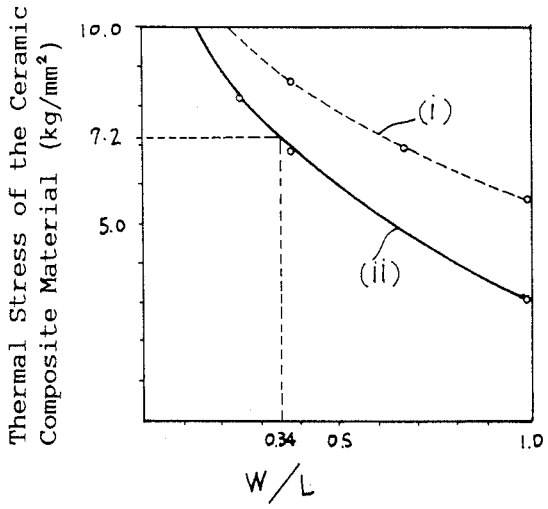
FIG. 14 is a graph showing the relationship between the thermal stress of the skid button and the width-to-length ratio of the horizontal section of the button.

FIG. 14 shows the relation of the thermal stress of the heat-resistant alloy forming the first member, as well as of the ceramic composite material forming the second member, with respect to the width to length ratio (W/L), wherein (W) represents width of the cross section and (L) represents length of the longitudinal section of the skid button (See FIG. 2 (I) (II)). The specimens used for the testing were 15 mm on the top of the first member with respect to the thickness of the second member. The thickness of the second member on the side of the first member was in the range of $(L+W-\sqrt{L^2+W^2})/4$ since the lower limit of the cross sectional area ratio S1/S2 is 50% as stated above. The test was conducted at a temperature of 1200° C. In the diagram, curve (i) represents the result achieved when the skid button was maintained at a uniform temperature in its entirety within a furnace, and curve (ii) represents the result achieved when the button was cooled from below under the same condition as in actual operation. The diagram reveals that the greater the W/L ratio, the smaller is the thermal stress. It is thought that the allowable upper limit of thermal stress that will not result in cracking is 7.2 kg/mm$^2$, and the corresponding W/L value is at least 0.34.

As described in detail above, the walking beam type heating furnace equipped with skid beams of the present invention is adapted to uniformly heat the materials with occurrence of skid marks effectively prevented. The uniform heating effect enables the subsequent rolling process to afford products of improved quality with high stability. Further the skid button is excellent in impact resistance and in resistance to compressive deformation at high temperatures, is less susceptible to cracking due to thermal stresses and is therefore usable for a prolonged period of time with good stability.

It is to be understood that the present invention is not limited to the foregoing specific embodiments but can be modified variously within the technical scope defined in the appended claims.

What is claimed is:

1. A skid beam adapted for use in a walking beam type heating furnace of which operating temperature exceeds 1000° C., the skid beam comprising a hollow skid pipe of heat-resistant alloy, skid buttons provided upright on the top of the pipe and arranged axially thereof at a predetermined spacing, each skid button having a base portion, and a refractory lining covering the outer peripheral surface of the skid pipe and each of the skid buttons over the base portion thereof toward its upper portion, each of the skid buttons comprising a first member attached to the skid pipe and a second member to be brought into contact with the material to be heated, the first member being made of a heat-resistant alloy, the second member being made of a composite material having a matrix of a heat-resistant alloy and ceramic particles dispersed therein in an amount of 30 to 70% by weight based on the composite material, the skid button having a height exceeding 120 mm.

2. A skid beam as defined in claim 1 wherein the lining portion covering the skid button over the base portion thereof toward its upper portion is so dimensioned with respect to thickness so as not to give at least 40° C. of temperature difference between the top of the skid button and the interior of the furnace.

3. A skid beam as defined in claim 1 wherein the skid button has a height of about 200 mm.

4. A skid beam as defined in claim 1 wherein the first member has a flat top face, and the second member is superposed thereon.

5. A skid beam as defined in claim 1 wherein the first member has a projection approximately at the center of its top, and the second member is in the form of a ring covering the outer periphery of the projeciton.

6. A skid beam as defined in claim 1 wherein the first member has a projection approximat at the center of its top, and the second member is in the form of a cap covering the entire projection.

7. A skid beam as defined in claim 1 wherein the first member is in the form of a column extending from the outer peripheral surface of the skid pipe, and the second member covers the entire of the columnar first member.

8. A skid beam as defined in claim 7 wherein the skid button has a width-to-length ratio of at least 0.34 in cross section, and the second member occupies at least 50% of the skid button in cross sectional area.

* * * * *